US006301754B1

(12) United States Patent
Grunberger et al.

(10) Patent No.: US 6,301,754 B1
(45) Date of Patent: Oct. 16, 2001

(54) MAGNETIC CLOSURE DEVICE FOR CLOTHING ITEMS, LEATHER GOODS AND THE LIKE

(75) Inventors: Erico Grunberger; Alberto Marchesi, both of Milan (IT)

(73) Assignee: Sama S.p.A., Ronco Briantino (IT)

( * ) Notice: Subject to any disclaimer, the term of this patent is extended or adjusted under 35 U.S.C. 154(b) by 0 days.

(21) Appl. No.: 09/313,215

(22) Filed: May 18, 1999

(30) Foreign Application Priority Data

May 22, 1998 (IT) ..... MI98A1150

(51) Int. Cl.[7] ..... A44B 21/00
(52) U.S. Cl. ..... 24/303
(58) Field of Search ..... 24/303, 66.1; 335/303, 335/302, 306, 285; 428/900; 600/15

(56) References Cited

U.S. PATENT DOCUMENTS 2,319,292 * 5/1943 Boggs .
2,389,298 * 11/1945 Ellis .
2,389,299 * 11/1945 Ellis .
2,797,370 * 6/1957 Bennett .
3,102,314 9/1963 Alderfer .
3,161,932 12/1964 Russell .
3,191,106 * 6/1965 Baermann .
3,254,859 * 6/1966 Reisch .
3,378,893 * 4/1968 Labek .
3,827,019 * 7/1974 Serbu .
4,197,618 * 4/1980 Bourguignon .
4,249,267 * 2/1981 Voss .
4,399,595 * 8/1983 Yoon et al. .
5,604,960 2/1997 Good .

FOREIGN PATENT DOCUMENTS 0 818 155 1/1998 (EP) .
8-38627 * 2/1996 (JP) .

OTHER PUBLICATIONS

Patent Abstracts of Japan vol. 096, No. 006, Jun. 28, 1996 & JP 08 038627 A (Meiwa Gravure KK), Feb. 13, 1996 * abstract *.

* cited by examiner

*Primary Examiner*—James R. Brittain

(57) ABSTRACT

A magnetic closure device for items of clothing, leather goods and the like comprising at least one layer of magnetizable powder and at least one layer for covering the layer of magnetizable powder. At least the outer face of the covering layer is free from magnetizable powder.

20 Claims, 4 Drawing Sheets

MAGNETIC CLOSURE DEVICE FOR CLOTHING ITEMS, LEATHER GOODS AND THE LIKE

BACKGROUND OF THE INVENTION

The present invention relates to a magnetic closure device for items of clothing, leather goods and other fields of application.

It is known that magnetic rubbers, known as plastoferrites, are already commercially available and are substantially constituted by a mixture of rubber or plastics with magnetizable powders such as ferrite or rare earths.

The use of plastoferrites as magnetic closure for items of clothing or leather goods is not feasible because the product, regardless of the matrix material that constitutes the mix, acquires the color of the magnetic powders that it contains and therefore does not have a specific coloring.

Moreover, the magnetic powders, which are integral parts of the material, protrude externally; being metal powders, they are therefore subject to oxidations caused by use, washing and the like, with the possibility of separation of the powders and of rust, which can transfer onto the fabrics to which the closures are applied.

Further, in plastoferrites the magnetic force is constrained by the need to have a well-amalgamated mixture or compound and the higher the amount of metallic powder, the higher the magnetic characteristics, but on the other hand an increase in metal powder significantly reduces the mechanical characteristics of the compound and makes it fragile.

Moreover, plastoferrites are usually calendered in sheets and are then cut to size, without however forming a product which can be easily applied for example to an item of clothing, both because the outer edges of the strips are sharp and because easy stitching is not possible since the magnetic strip is not specifically preset for this.

SUMMARY OF THE INVENTION

The aim of the present invention is to solve the above-mentioned problem by providing a magnetic closure device for items of clothing, leather goods and the like which allows to provide a flexible strip closure which can be connected to the item of clothing, to the leather goods or the like so as to have an external degree of finish which is independent of the quantity and type of magnetizable powder used.

Within the scope of this aim, a particular object of the invention is to provide a magnetic closure device in which it is possible to increase at will the amount of magnetizable powder and therefore the obtainable magnetic force without thereby compromising in any way the mechanical and workability characteristics of the magnetic closure.

Another object of the invention is to provide a magnetic closure device which can be sewn or in any case applied to an item of clothing without encountering particular problems and so as to achieve full isolation of the region that contains magnetic parts from the outside, thus solving the problems produced by wear, rust and potential separation of magnetic particles.

Another object of the present invention is to provide a magnetic closure device which, by virtue of its particular constructive characteristics, is capable of giving the greatest assurances of reliability and safety in use.

This aim, these objects and others which will become apparent hereinafter are achieved by a magnetic closure device for items of clothing, leather goods and the like, according to the invention, characterized in that it comprises at least one layer of magnetizable powders and at least one layer for covering said layer of magnetizable powders, at least the outer face of said covering layer being free from magnetizable powder.

BRIEF DESCRIPTION OF THE DRAWINGS

Further characteristics and advantages will become apparent from the description of possible embodiments of a magnetic closure device for items of clothing, leather goods and the like, illustrated only by way of non-limitative example in the accompanying drawings, wherein.

DESCRIPTION OF THE PREFERRED EMBODIMENTS

Figure 1:
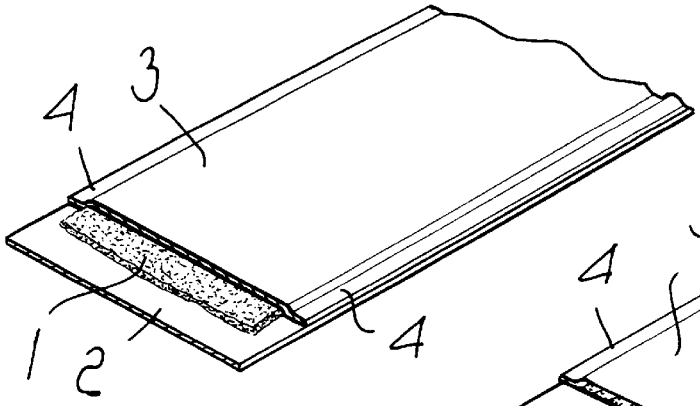
FIG. 1 is a schematic layered perspective view of a magnetic closure device constituted by a strip with a covering layer and a lower layer.
Figure 2:
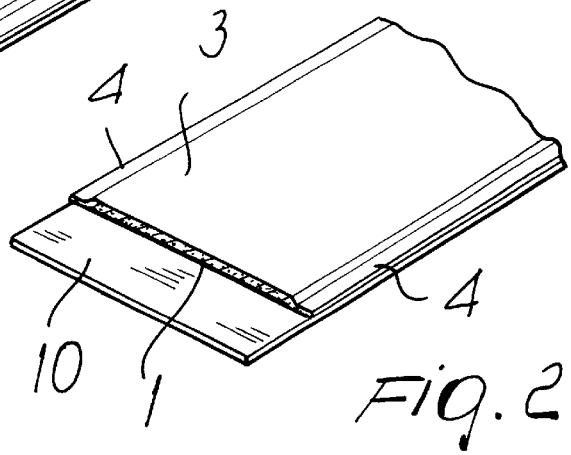
FIG. 2 is a view of a magnetic closure device constituted by a strip with a covering layer which can be provided on a layer of paper and can be directly applied to a fabric.

With reference to the above figures, the magnetic closure device for items of clothing, leather goods and the like, according to the invention, is normally provided in the form of a strip, and in a preferred embodiment there is provided a layer of magnetizable powder, designated by the reference numeral 1, which is applied to a backing layer 2 normally provided by means of a film of plastic material or the like.

A covering layer 3 is applied to the layer of magnetizable powder and is preferably provided by spreading plastic material so that at least part of the magnetizable powder is embedded in the covering layer, while the outer face of the covering layer is entirely free from magnetizable powder.

Preferably at the longitudinal edges there are provided bands 4 which are not affected by magnetic material and are generally preset for the stitching or thermal bonding of the strip onto an item of clothing, a leather item or the like.

The magnetizable powder is then magnetized either by a north or south magnetization or with a variously distributed bipolar magnetization.

According to a different embodiment, it is possible to deposit the layer of magnetizable powder onto a paper backing 10 and then apply the covering layer that embeds the magnetizable powder, so that the magnetizable powder becomes an integral part of the covering layer and more specifically of the inner face of the covering layer.

The outer face is again smooth and free from magnetic powder.

The resulting strip can be applied by thermal bonding directly to the synthetic fabric of an item of clothing. The layer of magnetizable powder can be continuous or optionally provided by means of separate regions, designated by the reference numeral 1' in FIG. 4, always providing a region in which the magnetizable material is confined within a layer whose degree of external finish can vary at will and is in any case unaffected by the magnetizable powder.

In order to easily distribute the powders on the support, it is possible to use an electromagnet or in any case a magnetic band, so as to exactly delimit the region where the magnetizable powders can be deposited.

According to a different embodiment, shown in FIGS. 7 to 13, the magnetic closure device for items of clothing, leather goods and the like comprises a plurality of magnetic blocks 50 which, in the embodiment shown in FIGS. 7 to 11, are substantially plate-shaped.

The magnetic blocks are arranged so as to be mutually interleaved and are mutually aligned and advantageously positioned between a covering strip 51 and a backing strip 52.

Figure 9:
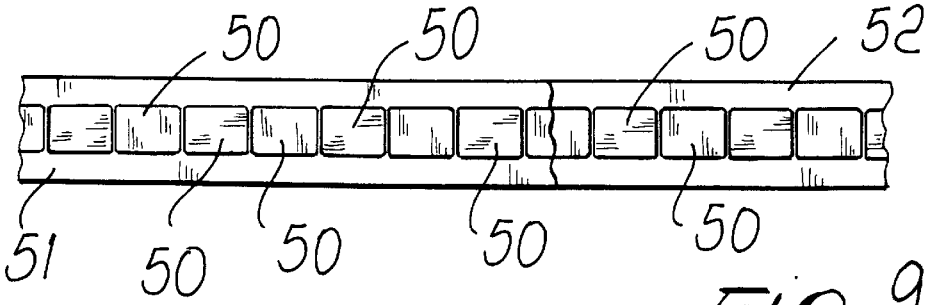
FIG. 9 is a plan view of the coupling between the strips provided on the two flaps be joined.
Figure 10:
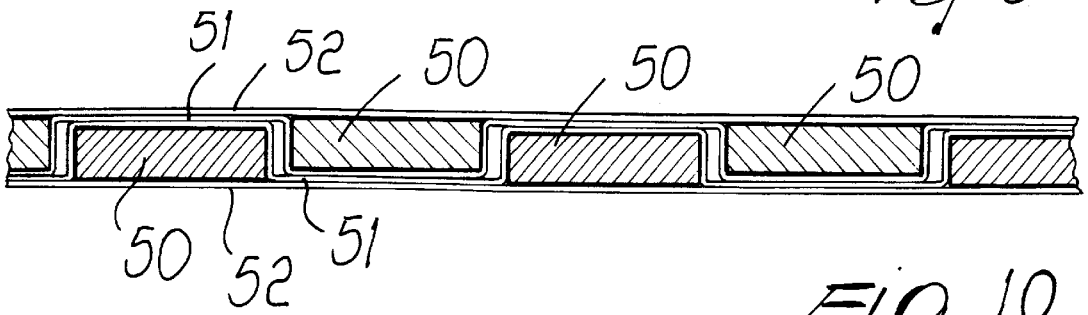
FIG. 10 is a sectional view of the coupled strips.
Figure 11:
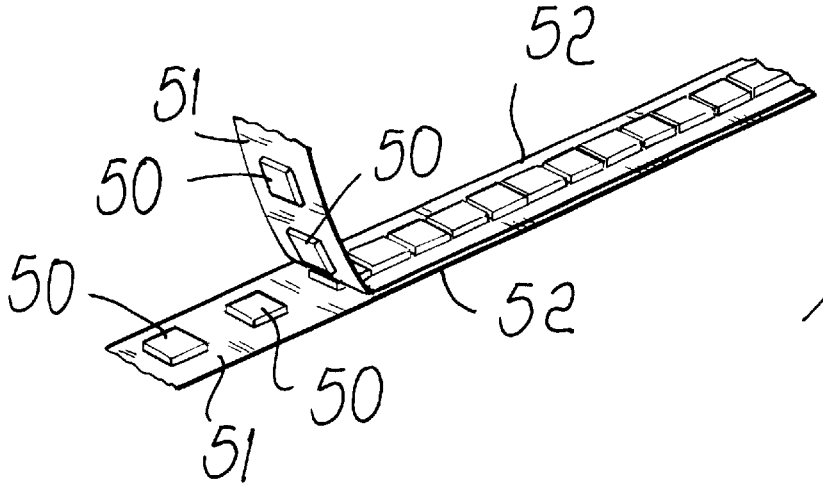
FIG. 11 is a schematic perspective view of the step for separating the magnetic strips.

The magnetic blocks 50, whose mutual distance is at least equal to their dimensions in the alignment direction, advantageously have a flux which is orientated along the alignment axis of the various blocks, so that it is possible to close the two flaps by coupling the magnetic blocks on the strips provided respectively on either flap, which provide a mutual interlock between the magnetic blocks of one strip and the magnetic blocks of the other strip, thus providing an assembly in which the flux is orientated along the longitudinal axis, as shown schematically in FIGS. 9 and 10.

When the strips are coupled, leakage would occur only at the ends, where it is possible to provide terminal portions 60 made of soft magnetic material which embed the last magnet of the row and accordingly significantly eliminate flux leakages.

Figure 12:
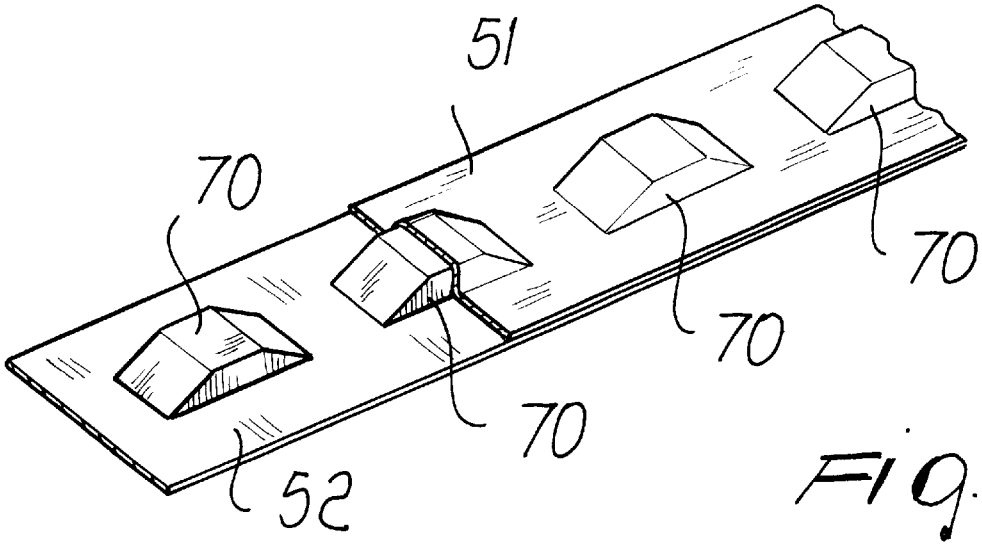
FIG. 12 is a perspective view of a strip with trapezoidal magnetic blocks.
Figure 13:
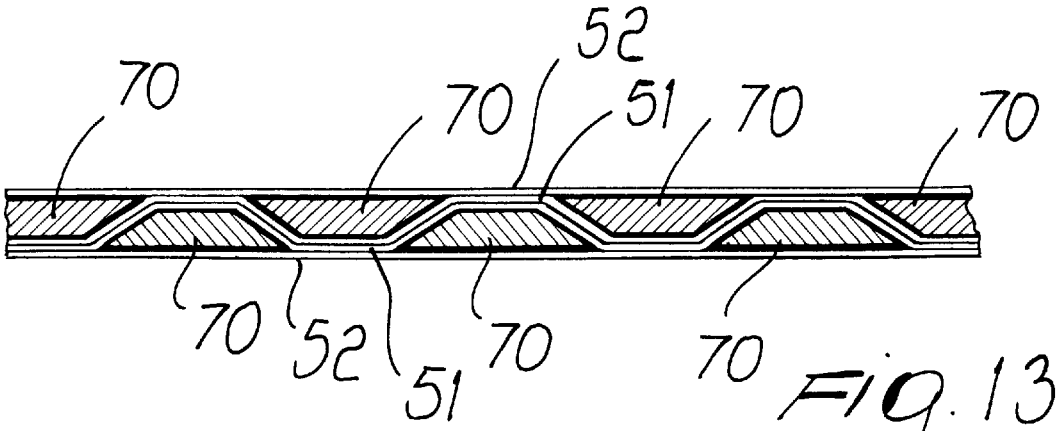
FIG. 13 is a schematic sectional view of mutually coupled strips with trapezoidal magnetic blocks.
Figure 14:
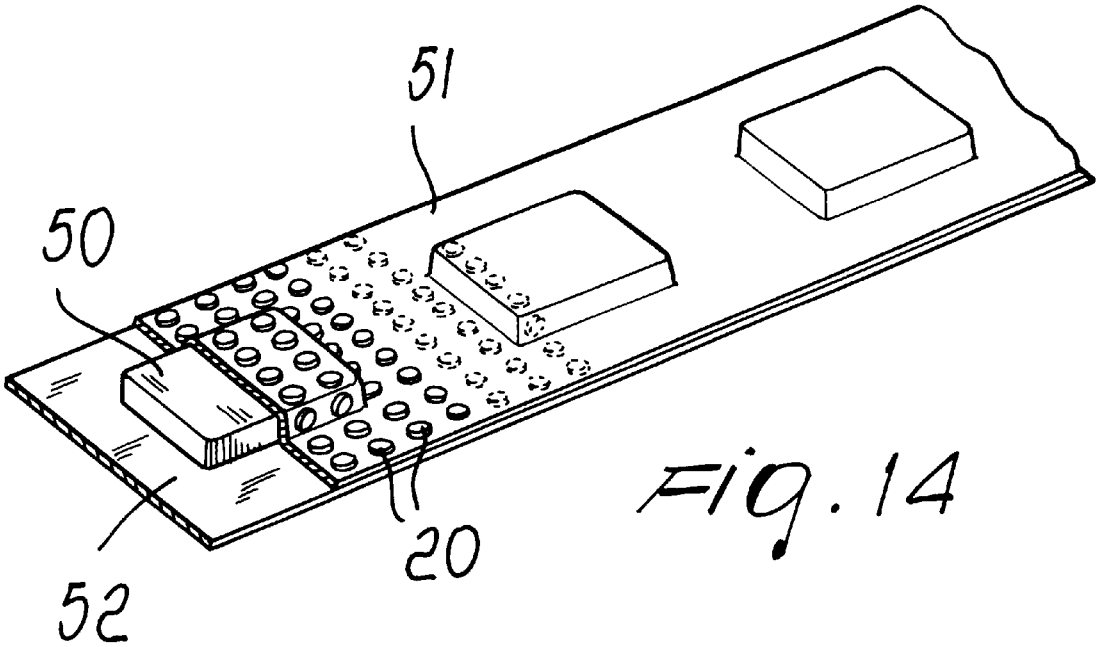
FIG. 14 is a perspective view of a different embodiment of the magnetic closure device illustrated in FIG. 7.
Figure 15:
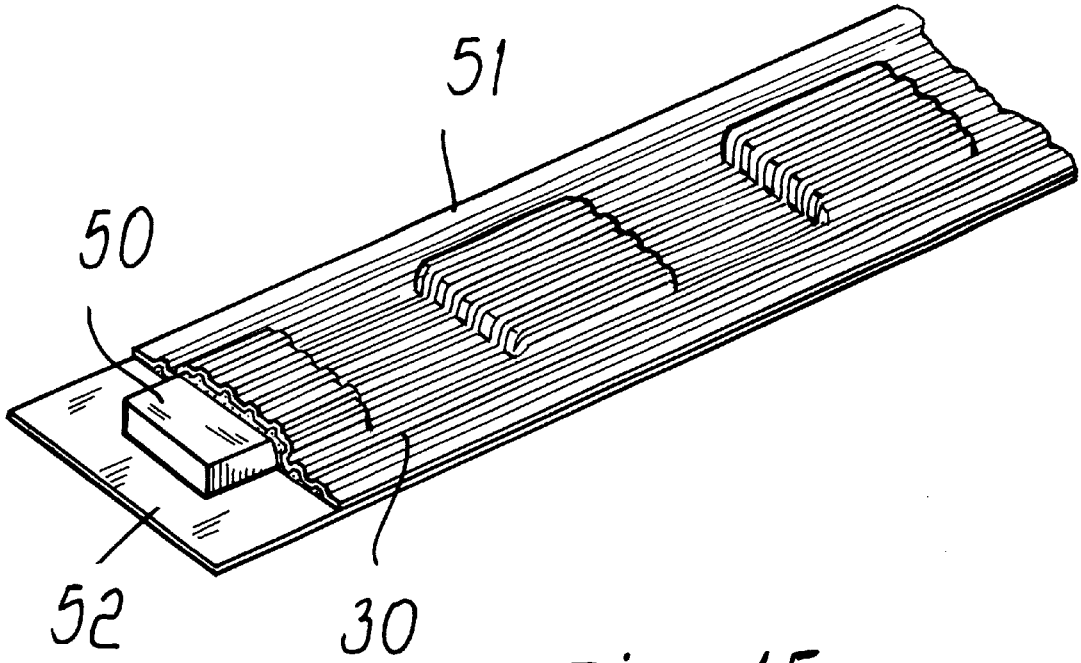
FIG. 15 is a perspective view of a still further embodiment of the magnetic closure device illustrated in FIG. 7.

As shown in FIGS. 12 and 13, in order to facilitate the mutual interlocking of the magnets of the two strips it is possible to provide blocks which have a trapezoidal shape, designated by the reference numeral 70, which in practice form a mutual coupling interlock.

Figure 4:
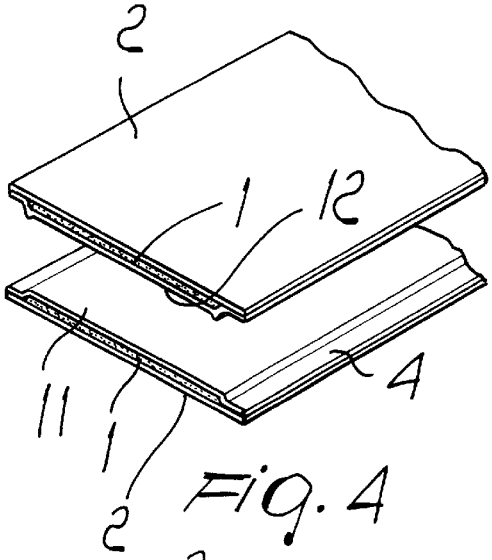
FIG. 4 is a schematic view of a magnetic closure device with strip elements provided with mutual coupling means in order to achieve a mechanical fastening.
Figure 3:
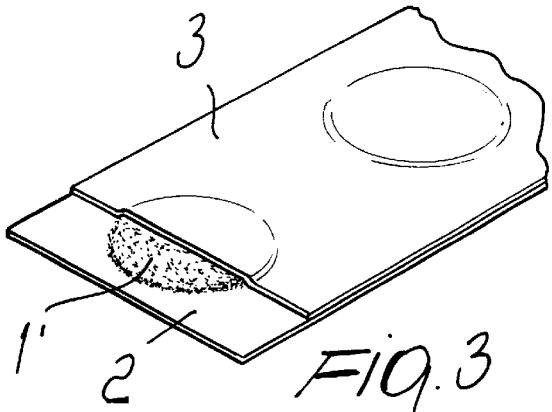
FIG. 3 is a schematic view of a magnetic closure device having separate magnetic regions.
Figure 5:
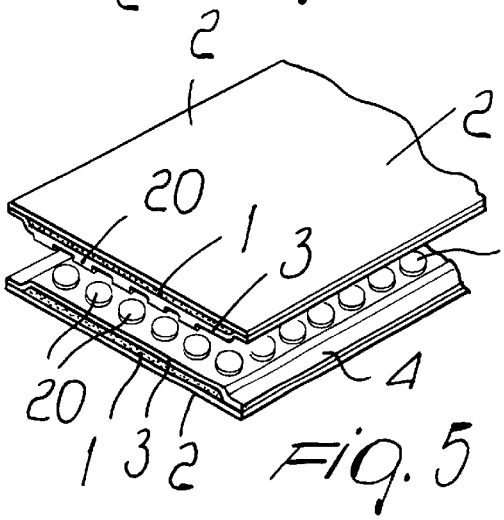
FIG. 5, is a schematic view of magnetic closure strips with mutual coupling pins.

In all of the above-described embodiments, in order to combine a mechanical action with the magnetic coupling action of the two strips it is possible to provide said two strips to be mutually associated, as shown in FIG. 4, with a male strip in which the covering layer, designated by the reference numeral 11, has a male configuration which fits in a female seat 12 correspondingly formed in the facing strip.

It is also possible to use other refinements to provide a mechanical coupling together with the magnetic coupling, such as the provision of covering layers 3 which have, on their outer face, studs or pins 20 in a staggered arrangement which provide a mutual coupling, thus combining a mechanical resistance in two perpendicular directions in the coupling plane with the magnetic fastening action.

Figure 6:
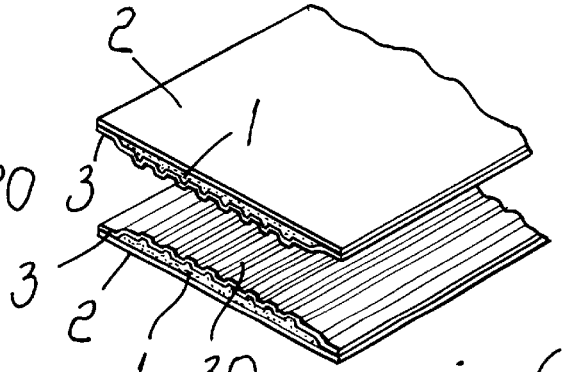
FIG. 6 is a view of magnetic closure strips with coupling teeth.
Figure 7:
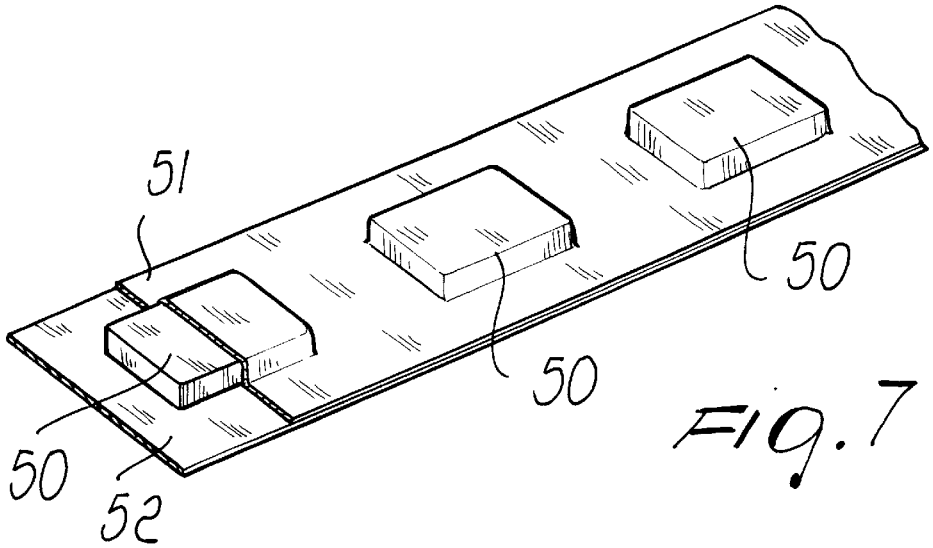
FIG. 7 is a schematic perspective view of a different embodiment of the magnetic closure device, obtained by means of magnetic blocks.
Figure 8:
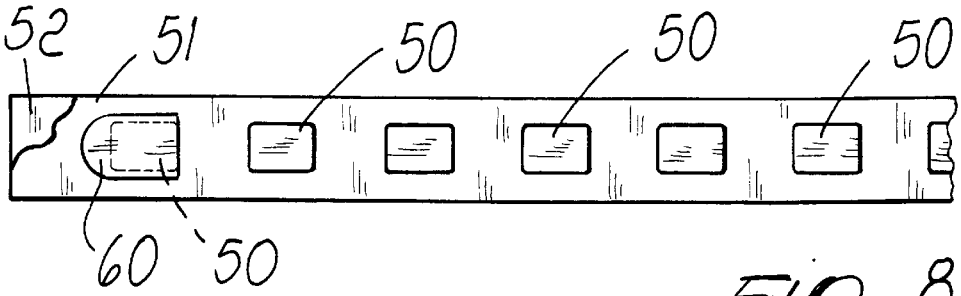
FIG. 8 is a plan view of the strip of FIG. 7.

According to the embodiment shown in FIG. 6, it is possible to provide, on the outer face of the covering layer, grooves or teeth, designated by the reference numeral 30, which provide a coupling of the interlock type with increased mechanical strength in the direction at right angles to the extension of the teeth.

The covering layer and therefore the strip that is obtained can be colored at will, is completely free from metallic powders, which are sealed internally, and can be sewn in regions without metallic parts and cannot oxidize.

It is also possible to adjust at will the magnetic attraction force simply by varying the amount or type of the magnetizable powders, thus obtaining different magnetic forces without acting on the mechanical characteristics of the product, as instead occurs with conventional plastoferrites, in which an increase in magnetic material leads to greater fragility of the product.

The invention thus conceived is susceptible of numerous modifications and variations, all of which are within the scope of the inventive concept.

All the details may also be replaced with other technically equivalent elements.

In practice, the materials employed, so long as they are compatible with he specific use, as well as the contingent shapes and dimensions, may be any according to requirements.

The disclosures in Italian Patent Application No. MI98A001150 from which this application claims priority are incorporated herein by reference.

What is claimed is:

1. A magnetic closure device for items of clothing, leather goods and the like, comprising a first plurality of magnetic blocks which are mutually spaced and mutually aligned, said magnetic blocks being arranged at a first covering strip which can be coupled to one of the flaps to be joined, said magnetic blocks being adapted to couple with a second plurality of magnetic blocks arranged at a second covering strip which can be coupled to another one of said flaps to be joined, the magnetic blocks of said first plurality and of said second plurality of magnetic blocks coupling with a mutual interlock, each of the magnetic blocks arranged at said first strip being arranged adjacent to a corresponding one of the magnetic blocks arranged at said second strip.

2. The magnetic closure device according to claim 1, wherein said magnetic blocks have a mutual distance which is at least equal to the dimension of said blocks in an alignment direction.

3. The magnetic closure device according to claim 1, wherein said magnetic blocks have a flux which is orientated substantially in the mutual alignment direction.

4. The magnetic closure device according to claim 1, wherein said magnetic blocks have a substantially plate-like configuration.

5. The magnetic closure device according to claim 1, wherein said magnetic blocks have a substantially trapezoidal shape in a cross-section taken along an alignment direction.

6. The magnetic closure device according to claim 1, comprising, at the end of said first and second plurality of magnetic blocks, a terminal portion made of soft magnetic material which embeds the last one of said blocks.

7. The magnetic closure device according to claim 1, comprising a supporting strip Which can be coupled to said covering strip and embeds said magnetic blocks.

8. The magnetic closure device according to claim 1, wherein said magnetic blocks of said first strip are each arranged head to head with a corresponding magnetic block of said second strip.

9. The magnetic closure device according to claim 1, wherein said covering layer has, on its outer face, elements for interlock coupling with the outer face of the associable covering layer.

10. The magnetic closure device according to claim 1, wherein said outer face of said covering layer has stud-like protrusions which can be coupled to identical stud-like protrusions.

11. The magnetic closure device according to claim 1, wherein said outer face of said covering layer has teeth or grooves which can be mutually coupled.

12. A magnetic closure device for items of clothing, leather goods and the like, comprising a plurality of magnetic blocks which are mutually spaced and mutually aligned in a row, said magnetic blocks being arranged at a covering strip which can be coupled to one of the flaps to be joined, further comprising, at the end of the row of magnetic blocks, a terminal portion made of soft magnetic material which embeds a last one of said blocks.

13. The magnetic closure device according to claim 12, wherein said magnetic blocks have a mutual distance which is at least equal to the dimension of said blocks in an alignment direction.

14. The magnetic closure device according to claim 12, wherein said magnetic blocks have a flux which is orientated substantially in the mutual alignment direction.

15. The magnetic closure device according to claim 12, wherein said magnetic blocks have a substantially plate-like configuration.

16. The magnetic closure device according to claim 12, wherein said magnetic blocks have a substantially trapezoidal shape in a cross-section taken along an alignment direction.

17. The magnetic closure device according to claim 12, comprising a supporting strip which can be coupled to said covering strip and embeds said magnetic blocks.

18. The magnetic closure device according to claim 12, wherein said covering layer has, on its outer face, elements for interlock coupling with the outer face of the associable covering layer.

19. The magnetic closure device according to claim 12, wherein said outer face of said covering layer has stud-like protrusions which can be coupled to identical stud-like protrusions.

20. The magnetic closure device according to claim 12, herein said outer face of said coveting layer has teeth or grooves which can be mutually coupled.

* * * * *